United States Patent [19]

Theurer et al.

[11] Patent Number: 4,896,460

[45] Date of Patent: Jan. 30, 1990

[54] RAIL GRINDING MACHINE

[75] Inventors: Josef Theurer, Vienna; Herbert Wörgötter, Linz, both of Austria

[73] Assignee: Franz Plasser Bahnbaumaschinen Industriegesellschaft m.b.H., Vienna, Austria

[21] Appl. No.: 165,513

[22] Filed: Mar. 8, 1988

[30] Foreign Application Priority Data

May 12, 1987 [AT] Austria ..... 1200/87

[51] Int. Cl.[4] ..... E01B 31/17

[52] U.S. Cl. ..... 51/178

[58] Field of Search ..... 51/178

[56] References Cited

U.S. PATENT DOCUMENTS

| | | | |
|---|---|---|---|
| 2,096,424 | 10/1937 | Cooney | 51/178 |
| 3,090,170 | 5/1963 | Slattery | 51/178 |
| 3,129,535 | 4/1964 | Slattery | 51/178 |
| 4,249,346 | 2/1981 | Theurer et al. . | |
| 4,295,764 | 10/1981 | Theurer et al. | 51/178 |
| 4,768,312 | 9/1988 | Williams | 51/178 |

FOREIGN PATENT DOCUMENTS

| | | |
|---|---|---|
| 221131 | 10/1961 | Austria . |
| 110246 | 6/1984 | European Pat. Off. . |

*Primary Examiner*—Roscoe V. Parker
*Attorney, Agent, or Firm*—Kurt Kelman

[57] ABSTRACT

A rail grinding unit comprises a support frame having opposite ends, an undercarriage having flanged wheels supporting each support frame end on the rails for mobility along a railroad track, a vertically adjustable carrier frame mounted on the support frame, an endless grinding band mounted on the carrier frame and trained about guide rollers under tension for rotation thereabout, a lower one of the guide rollers constituting a pressure roll for pressing the endless grinding band into grinding contact with the surface, and a vertical adjustment device connected to at least one of the frames for adjusting the depth of the grinding contact of the endless grinding band with the pressure roll in relation to the surface, the vertical adjustment device including a remote-controlled drive for operating the vertical adjustment device.

13 Claims, 2 Drawing Sheets

RAIL GRINDING MACHINE

BACKGROUND OF THE INVENTION

1. Field of the Invention

The present invention relates to a rail grinding unit for grinding surface irregularities on a rail head of at least one rail of a railroad track having two rails, which comprises a support frame having opposite ends, an undercarriage having flanged wheels supporting each support frame end on the rails for mobility along the railroad track, a vertically adjustable carrier frame mounted on the support frame, an endless grinding band mounted on the carrier frame and trained about guide rollers under tension for rotation thereabout, a lower one of the guide rollers constituting a pressure roll for pressing the endless grinding band into grinding contact with the surface, and drive means for moving the endless grinding band about the guide rollers.

2. Description of the Prior Art

U. S. Pat. No. 4,249,346, dated Feb. 10, 1981, discloses a continuously advancing rail grinding machine for grinding surface irregularities on a rail head of a railroad track rail The machine has a sequence of tool carriers with sliding whetstones as grinding tools. A crank drive reciprocates the tool carriers to impart an operating movement to the whetstones and the reciprocating operating movement is superimposed on the continuous forward movement of the machine to obtain a high grinding efficiency. The patent also discloses an embodiment of a rail grinding machine wherein the rail grinding tools are vertically adjustable endless grinding bands trained about two guide rollers arranged sequentially in the direction of the track. A drive motor continuously moves the grinding band about the guide rollers to impart an operating movement to the grinding band which is superimposed on the continuous forward movement of the machine. This produces a high grinding efficiency while producing high-quality grinding of the rail head surface.

Austrian Pat. No. 221,131, of Oct. 15, 1961, discloses a rail grinding machine comprising a grinding unit with a rail grinding band. The grinding unit is vertically adjustably linked to the frame of the machine and is supported on the track rails by flanged rollers. The rail grinding band is trained about two guide rollers facing the running surface of the rail head of a respective track rail and is then reeled over a drive crank. As soon as a section of the grinding band in operating contact with the rail head running surface is worn out, this grinding band section is reeled over the drive crank to expose a subsequent grinding band section reeled off a storage roll. The grinding movement of the grinding band is provided only by the forward movement of the machine and the grinding efficiency is, therefore, very low while the operating life of each grinding band section is very short because of the linear contact thereof with the rail head surface.

European Pat. No. 0 110 246, whose grant was published Feb. 19, 1986, discloses a rail grinding machine which is manually movable along one or both rails of a railroad track. The machine comprises a grinding unit with a frame supported by flanged rollers on the track and an endless grinding band trained over two guide rollers mounted thereon. A carrier frame connected to the grinding band and an actuating motor is manually vertically adjustable with respect to the grinding unit frame by means of a screw drive and is rotatable about a vertical axis. In addition, the carrier frame with the endless grinding band is manually pivotal with respect to the grinding unit frame about an axis extending in the longitudinal direction of the track to incline the grinding band to a desired extent with respect to the rail head. The machine may be removed from the track on an outrigger equipped with rollers. Such a light, manually operated machine has a low grinding efficiency and is used only for spot grinding, accurate surfacing being impossible because of the manual operation. Coupling this machine to a motor-driven car will not avoid these disadvantages but will even cause additional down times to permit intermittent manual adjustments. Furthermore, the profiled pressure roll constituted by one of the guide rollers extends far beyond the rounded edges of the rail head, which causes an excessive transverse curvature of the grinding band, leading to a short operating life of the band.

SUMMARY OF THE INVENTION

It is the primary object of this invention to provide a rail grinding unit of the first-described type which produces a high grinding accuracy and uniformity over the entire running surface of the rail head while operating at a high efficiency.

The above and other objects are accomplished in such a rail grinding unit according to the invention with a vertical adjustment device connected to at least one of the grinding unit frames for adjusting the depth of the grinding contact of the endless grinding band with the pressure roll in relation to the rail head surface, the vertical adjustment device including a remote controlled drive for operating the vertical adjustment device.

This arrangement makes it possible to adjust the rail grinding band accurately with respect to the rail head surface to be ground so that a uniform and accurate grinding result is obtained, which avoids damaging overheating of the rail head material adjoining the ground irregularities. If the support frame is vertically adjustable in addition to the grinding unit carrier frame, the grinding unit carrier frame with the grinding band may advantageously be lowered before the grinding operation is initiated into a zero position in which the grinding band is just out of contact with the rail head surface. Subsequent vertical adjustment of the support frame with the grinding unit carrier frame in its fixed zero position makes it possible to set the depth of the grinding contact of the endless grinding band in relation to the rail head surface with the desired accuracy. This accurate adjustment in relation to an exact fixed position is of particular significance since the grinding depth in a single grinding pass lies within a relatively small range of only a few tenths of a millimeter.

The above and other objects, advantages and features of the present invention will become more apparent from the following detailed description of certain now preferred embodiments thereof, taken in conjunction with the accompanying drawing.

DESCRIPTION OF THE PREFERRED EMBODIMENTS

Figure 1:
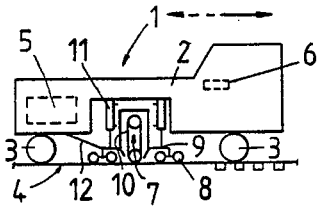
FIGS. 1 to 5 are highly simplified, schematic side views of five embodiments of a rail grinding machine and unit, respectively, according to this invention, FIGS. 1 to 3 showing a machine frame and an undercarriage supporting opposite ends of the machine frame on the track for mobility therealong, a vertically adjustable grinding unit being arranged between the undercarriages at the opposite machine frame ends in the embodiment of FIG. 1, three like sequentially arranged grinding units per rail being arranged between the undercarriages in the embodiment of FIG. 2, a rail planing machine preceding the rail grinding machine in the embodiment of FIG. 3, FIG. 4 showing a grinding unit with an endless grinding band trained over at least three guide rollers and FIG. 5 showing a similar grinding unit, with the lower guide roller being vertically adjustable to function as a pressure roll.

Referring now to the drawing and first to FIG. 1, there is shown rail grinding machine 1 for continuously grinding surface irregularities of a rail head of at least one rail of railroad track 4 having two rails fastened to ties. The machine comprises machine frame 2, undercarriages 3 supporting opposite ends of machine frame 2 on track 4 for mobility therealong in an operating direction indicated by a double-headed arrow and drive 5 for moving the machine frame along the track. Control panel 6 in an operator's cab on the machine frame enable an operator to operate the various machine drives. Grinding unit 7 for grinding the rail head surface irregularities is arranged between undercarriages 3 and comprises support frame 9 and undercarriages 8 supporting support frame 9 on track 4 between machine frame undercarriages 3. Endless grinding band 10 is mounted on a carrier frame vertically adjustable on support frame 9. The rail grinding unit is illustrated in detail in FIGS. 6 to 9 and its structure and operation will be described fully hereinafter in connection with these figures. Pulling rod member 12 connects grinding unit 7 to machine frame 2 for movement therewith. Preferably, a respective grinding unit is associated with each track rail for grinding both rails simultaneously as machine 1 moves along the track. Such a machine operates at high efficiency because the continuously rotating endless grinding band movement is superimposed on the continuous forward movement of the machine. Vertical adjustment drive means 11 connects grinding unit 7 to machine frame 2. Cylinder-piston drives 11 mount rail grinding unit 7 on machine frame 2 to lift the grinding unit off the track when the machine is to be moved between operating sites.

Figure 2:
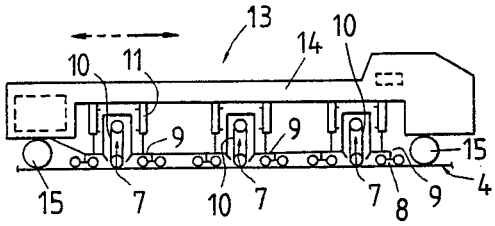

FIG. 2 schematically shows rail grinding machine 13 for continuously grinding surface irregularities of a rail head of at least one rail of railroad track 4 having two rails fastened to ties. The machine comprises machine frame 14, undercarriages 15 supporting opposite ends of machine frame 14 on track 4 for mobility therealong in an operating direction indicated by a double-headed arrow and a drive for moving the machine frame along the track. Three like grinding units 7 for grinding the rail head surface irregularities are arranged between undercarriages 15 sequentially in the longitudinal direction of the railroad track, each comprising vertically adjustable support frame 9 and undercarriages 8 supporting support frame 9 on track 4 between machine frame undercarriages 15. Endless grinding band 10 is mounted on a carrier frame vertically adjustably mounted on support frame 9. Pulling rod members connect leading grinding unit 7 to machine frame 2 and the succeeding grinding units to each other for movement with the machine frame. Preferably, a respective series of grinding units is associated with each track rail for grinding both rails simultaneously as machine 13 moves along the track. Such a machine with a sequence of grinding units operates at a particularly high efficiency and, furthermore, makes it possible to proceed with the grinding in stages by using grinding bands of different coarseness. For example, band 10 of leading grinding unit 7 may be the coarsest to obtain rough grinding of the greatest surface irregularities while the succeeding grinding units may have abrasive bands of successively finer grains to obtain fine grinding. Respective vertical adjustment drive 11 connects each grinding unit 7 to machine frame 14. Each grinding unit is of the same structure and is operated in the manner as indicated hereinabove in connection with FIG. 1.

Figure 3:
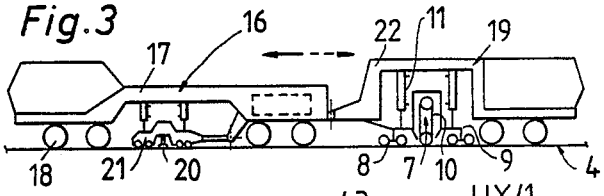

The combination machine schematically illustrated in FIG. 3 comprises rail planing machine 16 preceding rail grinding machine 19 in an operating direction, planing device 21 including vertically adjustable planing knife 20 for continuously planing the rail head before it is ground by endless grinding band 10 on grinding unit 7 vertically adjustably mounted on machine frame 22 of the rail grinding machine by vertical adjustment drives 11. As in the embodiments of FIGS. 1 and 2, the rail grinding unit is supported by undercarriages 8 on railroad track 4 between undercarriages supporting machine frame 22 on the track. The rail planing machine has carrier frame 17 vertically adjustably supporting the rail planing device and supported by undercarriages 18 on the track. The rear end of carrier frame 17 is pivotally coupled to the front end of frame 22 of rail grinding machine 19. The rail planing device runs on guide rollers on the track rails. The grinding unit of the combined machine is operated in the same manner as indicated hereinabove in connection with the description of FIGS. 1 and 2. Such a combined machine is particularly useful for working on heavily worn rails since the planing device preceding the grinding unit is able to remove great surface irregularities continuously by cutting them off the rail head surface before the same is ground to its desired profile.

Figure 4:
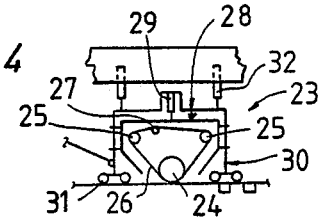

In rail grinding unit 23 schematically shown in FIG. 4, endless grinding band 26 is trained about guide rollers 24, 25 under tension provided by tension roller 27 arranged between upper guide rollers 25, lower guide roller 24 constituting a pressure roll for pressing endless grinding band 26 into grinding contact with the surface of the rail head to be ground. The guide rollers and the endless grinding band are mounted on vertically adjustable carrier frame 28, and vertical adjustment device 29 including a remote-controlled drive connects the carrier frame to support frame 30. Undercarriages 31 support the opposite ends of support frame 30 on the track, and cylinder-piston drives 32 (like previously described vertical adjustment drive means 11) vertically adjustably mount the grinding unit support frame on the fragmentarily illustrated machine frame of a rail grinding machine, for example of the type shown in FIGS. 1 to 3.

Figure 5:
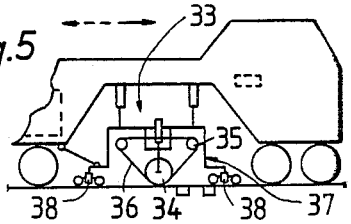

Rail grinding unit 33 schematically shown in FIG. 5 similarly comprises endless grinding band 36 trained about guide rollers 34, 35. The grinding band is held under tension by operating an adjustment drive vertically adjusting the spacing between lower guide roller 34 and upper guide rollers 35 wherebetween the lower guide roller is arranged, lower guide roller 34 constituting a pressure roll for pressing endless grinding band 36 into grinding contact with the surface of the rail head to be ground. The guide rollers and the endless grinding band are mounted on vertically adjustable carrier frame 36, and a vertical adjustment device 38 including a remote-controlled drive is arranged between support frame 37 and undercarriages supporting the opposite ends of support frame 37 on the track, and cylinder-piston drives vertically adjustably mount the grinding unit support frame on the fragmentarily illustrated machine frame of a rail grinding machine, for example of the type shown in FIGS. 1 to 3.

As shown in FIGS. 4 and 5, the two upper guide rollers over which the endless grinding band is trained are mounted on the carrier frame of the rail grinding unit sequentially in the longitudinal direction of the rail in a vertical plane and the pressure roll is arranged in this plane substantially centrally between the upper guide rollers. The pressure roll has a diameter larger than that of the upper guide rollers, preferably twice as large as that of the upper guide rollers. An endless grinding band trained about at least three guide rollers will enable the grinding unit to be constructed so compactly that it may be mounted under a machine frame of a rail grinding machine in a space of limited height, as may be the case in such rail grinding machines with elongated machine frames. Where the pressure roll is adjustable relative to the upper guide rollers, it is possible accurately to control the grinding depth of the band on a simple built support frame.

Figure 6:
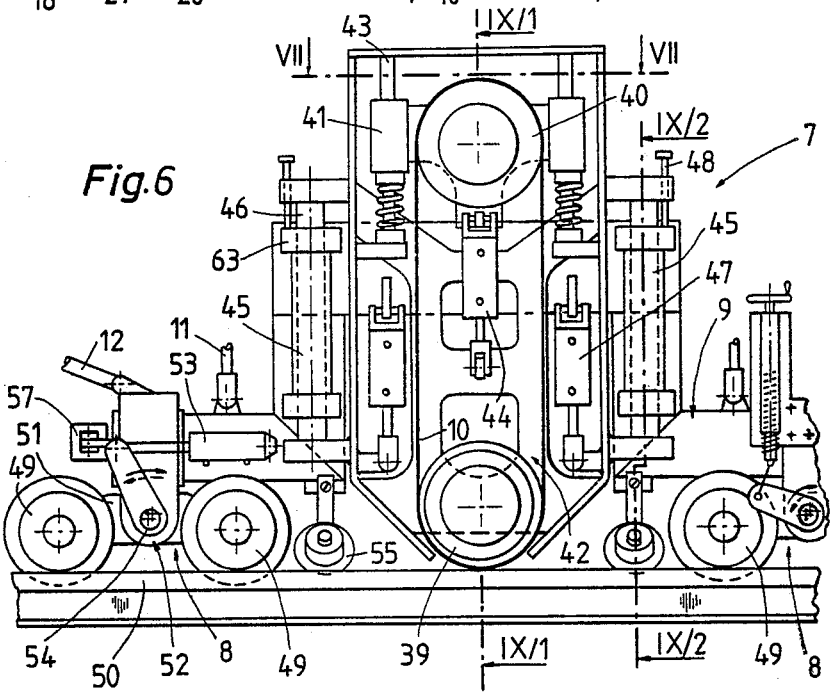
FIG. 6 is an enlarged side elevational view of the rail grinding unit schematically illustrated in FIGS. 1 to 3, with an endless grinding band trained over a lower and an upper guide roller;4

FIG. 6 shows rail grinding unit 7 in detail. The rail grinding unit comprises support frame 9 having opposite ends and undercarriages 8 having flanged wheels 49 supporting the opposite support frame ends on the rails of the railroad track for mobility along the railroad track. Vertically adjustable carrier frame 42 is mounted on support frame 9 and endless grinding band 10 is mounted on the carrier frame and trained about guide rollers 39, 40 under tension, lower guiding roller 39 being mounted on the carrier frame and constituting a pressure roll for pressing the endless grinding band into grinding contact with the rail head surface while upper guide roller 40 constitutes a tension roll holding the endless grinding band under tension. Vertically displaceable yoke-like carriage 41 rotatably bears tension roll 40 and vertical guide posts 43 are mounted on carrier frame 42 in a longitudinal plane of symmetry of endless grinding band 10, the plane of symmetry extending parallel to a vertical longitudinal plane defined by the rail. Respective ends of carriage 41 are vertically displaceably mounted on guide posts 43, and drive 44 is connected to the carriage for vertical displacement thereof. Vertical guides 45 are mounted on support frame 9 at respective sides of grinding unit carrier frame 42, and guide sleeves 46 on the carrier frame vertically displaceably mount the carrier frame on the vertical guides. A vertical adjustment device including remote-controlled pneumatic drives 47 interconnects the support and carrier frame for vertically displacing the carrier frame with respect to the support frame. Set screws 48 are mounted on the support frame for engaging the carrier frame to delimit the vertical downward displacement thereof. The described tensioning arrangement for endless grinding band 10 by operation of drive 44 assures a constant and uniform tensioning of the band. The remote control of this drive makes it possible to relax the grinding band immediately after the grinding operation has been completed, thus enabling a quick replacement of the band. The symmetrical vertical guidance of the carrier frame on the support frame assures an exact and quick vertical adjustment of the carrier frame without danger of jamming to enable the grinding band to be moved from an upper rest position to a lowered operating position. Adjustment of the set screw delimiting the downward movement of the carrier frame makes it possible to change the operating position of the grinding band, as may be required due to the wear of the band or other operating factors.

Support frame 9 defines an upwardly extending recess between the opposite ends thereof and, as shown, each undercarriage 8 has a pair of flanged wheels 49 associated with each rail and engaging rail head 50 thereof. Each undercarriage comprises cradle 51 extending in the direction of railroad track 4. Vertical adjustment drive 52 (similarly to above-described device 38) is arranged between a respective support frame end and undercarriage 8 at the associated frame end, the vertical adjustment drive comprising pivotal crank shaft 54 extending transversely to the railroad track and a remote-controlled drive is arranged for pivoting the crank shaft so that support frame 9 with grinding unit carrier frame 42 may be vertically adjusted, i.e. support frame 9 is vertically adjustable as well as carrier frame 42 being vertically adjustable on the support frame. At the left side of FIGS. 6 and 7, the remote-controlled drive is illustrated as a cylinder-piston drive. As shown at the right side of these figures, a manually operated spindle drive may be used at the opposite end of the support frame for rotating the crank shaft of the vertical adjustment device for support frame 9. This drive may be used additionally to remote-controlled drive 53 and/or pneumatic drives 47 for fine adjustment of the vertical adjustment. The exact vertical displacement of the support frame with the grinding unit carrier frame relative to the supporting undercarriages enables a fine tuning of the grinding depth. Since the carrier frame with the grinding band remains stationary during this support frame adjustment, the grinding band will be vertically adjusted in accordance with the support frame displacement stroke. Mounting the undercarriages on a crank shaft provides a very simple and stable vertical adjustment enabling even the smallest vertical adjustments of the grinding band to be made. Due to the cradle shape of the undercarriages, vertical positioning errors due to undulations on the running surface of the rail head will be minimized so that such errors will not be copied by the grinding band.

Figure 7:
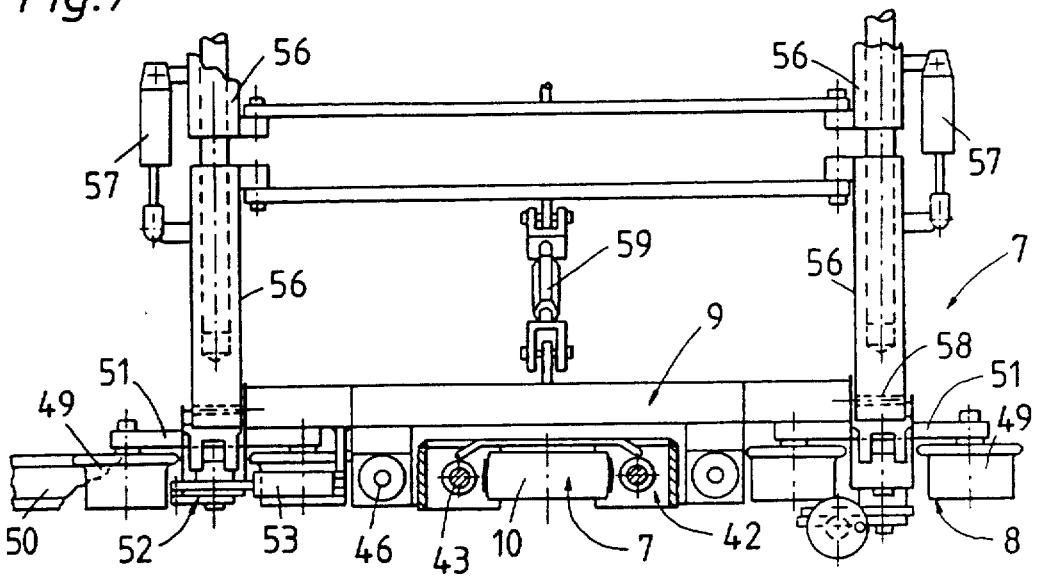
FIG. 7 shows a top view of the rail grinding unit along lines VII—VII of FIG. 6.
Figure 9:
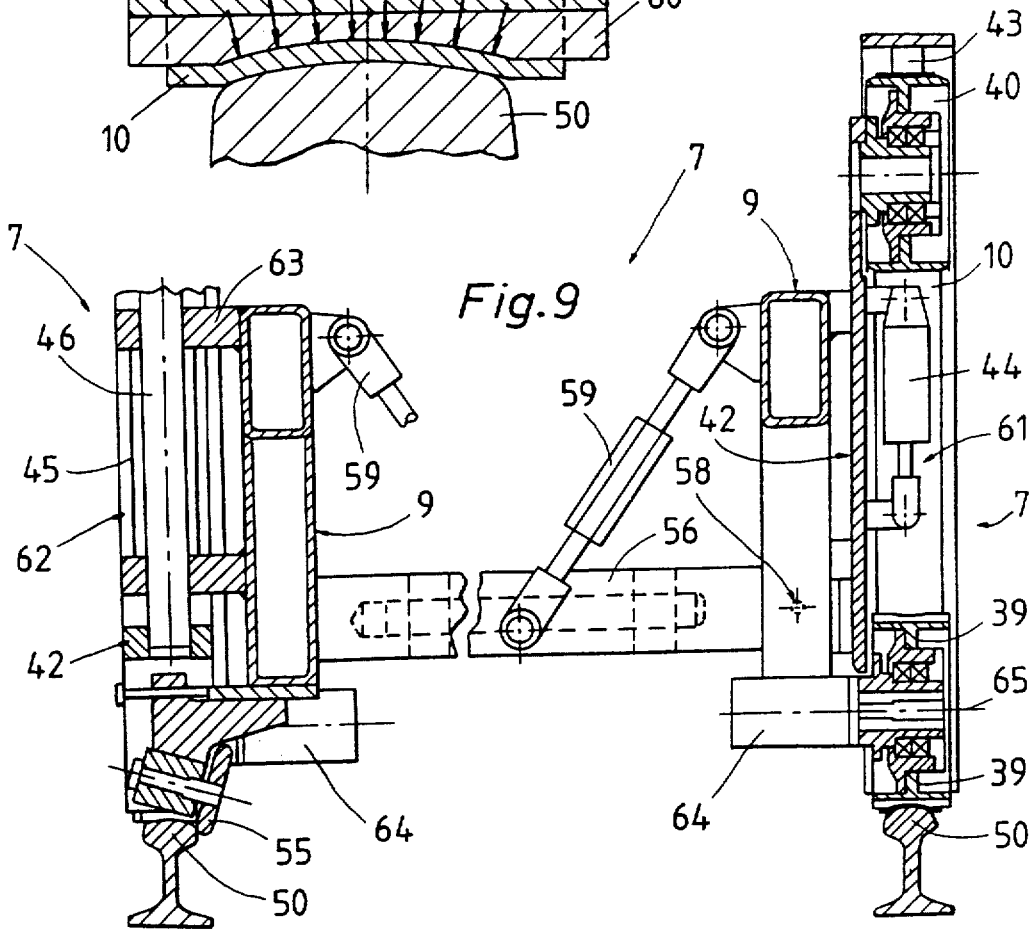
FIG. 9 shows, in the right half, a section of the grinding unit along line IX/1—IX/1 of FIG. 6 and, in the left half, a section along line IX/2—IX/2 of FIG. 6.

As shown in FIGS. 7 and 9, support frame 9 of rail grinding unit 7 comprises two support frame parts 61, 62 arranged mirror-symmetrically with respect to a longitudinally extending vertical plane of symmetry of the railroad track. Each support frame part 61, 62 carries a respective carrier frame 42 with guide rollers 39, 40 and endless grinding band 10 for continuously grinding irregularities on the running surfaces of rail heads 50 of both rails and has its own vertical adjustment device 52 with remote-controlled operating drive 53. A telescopic guide system comprised of a pair of parallel telescoping braces 56 interconnects the two support frame parts and spreading drives 57 are connected to the telescopic guide system for transverse displacement of the support frame parts with respect to each other. Each support frame part is pivotally mounted on a respective end of telescoping braces 56 for pivoting about axis 58 extending in the longitudinal direction of the track. Furthermore, the upper ends of the support frame parts are linked by tie rods carrying a turnbuckle 59 to a transverse rod interconnecting telescopic braces 56. This enables each support frame part with its grinding band to be suitably inclined with respect to the associated rail head to assume a desired grinding position. This arrangement provides a simple and compact grinding unit for simultaneously grinding both rails. The spreading of the telescopic guide system for the two support frame parts reduces any play between flanged wheels 49 of undercarriages 8 supporting support frame 9 and the rail heads because they readily adapt the unit to changes in the track gage and press the flanged wheels against the gage sides of rail heads 50, thus enhancing the grinding accuracy.

Figure 8:
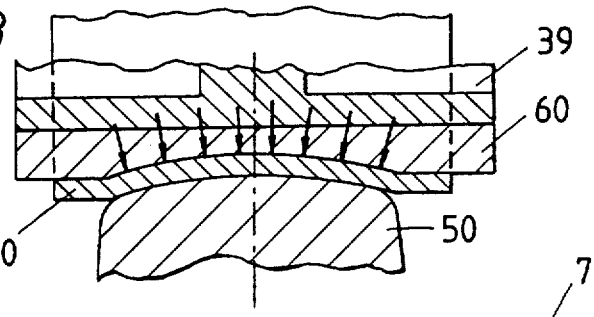
FIG. 8 is a greatly enlarged, fragmentary cross section of the lower guide roller constituting a pressure roll, as shown in FIG. 6, the endless grinding band being shown in the region of contact with the rail head surface to be ground.

As shown in FIG. 8, pressure roll 39 has a transverse profile corresponding to that of rail head 50, the pressure roll profile reaching only to the rounded edges of the rail head and being constituted by a flat arcuate curve of large radius in conformity with the running face of the rail head. The curved profile is delimited at both sides by narrow cylindrical sections extending parallel to the axis. This configuration of the pressing surface of roll 39 in conformity with the configuration of the rail head to be ground assures not only high-quality grinding but also enhances the grinding efficiency and the operating life of the abrasive band. Since the cylindrical edges of the pressing surface causes the corresponding edges of grinding band 10 adjoining the rail head at both sides also to extend parallel to the rotary axis of pressure roll 39, the grinding band will rotate smoothly and quietly even at high rotary speeds.

In the illustrated embodiment of pressure roll 39, it comprises circumferentially extending tubular body 60 having the above-described profile and this tubular body comprises a hard, elastically yielding material, such as a hard rubber having a hardness of 70 Shore. As indicated by the arrows in FIG. 8, this assures a uniform pressure of the pressure roll against the grinding band. An elastically yielding material of the indicated hardness produces a long operating life and a grinding accuracy assuring removal of even the smallest surface irregularities.

As shown in FIGS. 6 and 9, flanges 63 connect the ends of guide posts 45 for guide sleeves 46 of the carrier frames to support frame 9. Each pressure roll 39 on respective support frame part 61, 62 is rotatable by hydraulic drive 64 about axis 65 extending perpendicularly to the longitudinal extension of the track for rotating each endless grinding band 10. Guide rollers 55 are affixed to support frame parts 61, 62 and are arranged for tangential engagement with the gage sides of rail heads 50, which are not worn. The guide rollers are rotatable in a plane enclosing a dihedral angle of about 10° to about 20° with a vertical plane of symmetry of the rail. These guide rollers enable the support frame parts with their grinding bands to be guided accurately along the rail heads since they engage only a section of the rail heads which is not worn and has no irregularities.

The operation of rail grinding unit 7 illustrated in FIGS. 6 to 9 will now be explained in detail in connection with rail grinding machine 1:

As soon as the rail grinding machine has reached the operating site, vertical adjustment drives 11 are actuated to lower rail grinding unit into a position wherein flanged wheels 49 of undercarriages 8 of grinding unit support frame 9 engage rail heads 50 of railroad track 4. Thereupon, drives 47 are actuated to lower carrier frame 42 until set screws 48 engage support frame 9, the set screws being so adjusted that endless grinding band 10 trained over pressure roll 39 is just out of contact with underlying rail head 50. This is the zero position of the grinding band. The desired grinding depth of abrasive band 10 is then adjusted from this zero position by vertically adjusting the position of support frame 9, which is accomplished by the remote control of drives 53 of vertical adjustment device 52 to rotate crank shaft 54. This accurately adjusts the vertical position of support frame 9 with respect to undercarriage 8 and thus the vertical position of carrier frame 42 and endless grinding band 10. At the same time, spreading drives 57 are actuated to move support frame parts 61, 62 apart and to press tangential guide rollers 55 against the gage sides of rail heads 50, which are not worn. This assures an exact lateral guidance of the support frame parts, regardless of surface irregularities on other portions of the rail heads, with respect to a longitudinal vertical plane of symmetry of the rail. By turning turnbuckle 59, each grinding band may be adjusted to a desired inclination with respect to the associated rail head. After these adjustments for the desired operation of the endless grinding bands have been completed, hydraulic drives 64 are actuated to rotate pressure rolls 39 and thus to rotate endless grinding bands 10. As machine 1 is continuously advanced along the track by drive 5, rotating grinding bands 10 will uniformly, accurately and effectively grind the rail heads to remove surface irregularities therefrom. The remote control of drives 53 makes it possible to operate a respective vertical adjustment device 52 so that the surface cnnditions of each rail may be taken into consideration for the adjustment of a desired grinding depth with respect to each rail.

What is claimed is:

1. A rail grinding unit for grinding surface irregularities on a rail head of at least one rail of a railroad track having two rails, which comprises (a) a support frame having opposite ends, (b) an undercarriage having flanged wheels supporting each support frame end on the rails for mobility along the railroad track, (c) a carrier frame vertically adjustable mounted on the support frame, (d) an endless grinding band mounted on the carrier frame and being vertically adjustable with respect to the support frame, the grinding band being trained about guide rollers under tension for rotation thereabout, a lower one of the guide rollers constituting a pressure roll for pressing the endless grinding band into grinding contact with the surface, (e) a vertical adjustment device connected to the support frame for adjusting the depth of the grinding contact of the endless grinding band with the pressure roll in relation to the surface, the vertical adjustment device including a remote-controlled motor drive for operating the vertical adjustment device, (f) vertical guides mounting on the support frame at respective sides of the carrier frame and guide sleeves on the carrier frame for vertically displaceably mounting the carrier frame on the vertical guides, and (g) a set screw mounted on the support frame for engaging the carrier frame to delimit the vertical displacement thereof.

2. The rail grinding unit of claim 1, wherein the vertical adjustment device is arranged between at least one of the support frame ends and the undercarriage at the associated support frame end.

3. The rail grinding machine of claim 2, wherein the undercarriage has a pair of flanged wheels associated with each rail.

4. The rail grinding unit of claim 3, wherein the vertical adjustment device comprises a pivotal crank shaft extending transversely to the railroad track and the remote-controlled motor drive is arranged for pivoting the crank shaft, and the undercarriage comprises a cradle extending in the direction of the railroad track, the undercarriage cradle being rotatably mounted on the crank shaft and the flanged wheels being mounted at respective ends of the undercarriage cradle.

5. The grinding unit of claim 1, wherein the pressure roll has a transverse profile corresponding to that of the rail head, the pressure roll profile reaching only to the rounded edges of the rail head and being constituted by a flat arcuate curve of large radius in conformity with the running face.

6. The grinding unit of claim 5, wherein the pressure roll comprises a circumferentially extending tubular contact body having said profile, the tubular contact body being comprised of a hard, elastically yielding material.

7. The grinding unit of claim 6, wherein the material is hard rubber having a hardness of 70 Shore.

8. The rail grinding unit of claim 1, wherein the support frame of the grinding unit comprises two support frame parts arranged mirror-symmetrically with respect to a longitudinally extending vertical plane of symmetry of the railroad track, each of the support frame parts carrying a respective endless grinding band carrier frame for continuously grinding irregularities on the running surfaces of both rails, and further comprising a telescopic guide system interconnecting the two support frame parts and a spreading drive means connected to the telescopic guide system for transverse displacement of the carrier frame parts with respect to each other.

9. The rail grinding unit of claim 8, further comprising guide rollers affixed to the support frame parts and arranged for tangential engagement with the gage sides of the rail heads, the rollers being rotatable in a plane enclosing an angle of about 10° to about 20° with a vertical plane of symmetry of the rail.

10. The rail grinding unit of claim 1, further comprising another vertical adjustment device interconnecting the support frame and the carrier frame for vertically displacing the carrier frame on the support frame, the other vertical adjustment device including a remote-controlled motor drive for operating the other vertical adjustment device.

11. A rail grinding unit for grinding surface irregularities on a rail head of at least one rail of a railroad track having two rails, which comprises (a) a support frame having opposite ends, (b) an undercarriage having flanged wheels supporting each support frame end on the rails for mobility along the railroad track, (c) a carrier frame mounted on the support frame, (d) an endless grinding band mounted on the carrier frame and being vertically adjustable with respect to the support frame, (1) the grinding band being trained about guide rollers under tension for rotation thereabout, an upper one of the guide rollers constituting a tension roll holding the endless grinding band under tension and a lower one of the guide rollers constituting a pressure roll mounted on the carrier frame for pressing the endless grinding band into grinding contact with the surface, (e) a vertically displaceable carriage rotatably bearing the tension roll, (f) vertical guide posts mounted on the carrier frame in a longitudinal plane of symmetry of the endless grinding band, the plane of symmetry extending parallel to a vertical longitudinal plane defined by the rail, (1) respective ends of the carriage being vertically displaceably mounted on the vertical guide posts, (g) a drive for vertically displacing the carriage, and (h) a vertical adjustment device connected to the support frame for adjusting the depth of the grinding contact of the endless grinding band with the pressure roll in relation to the surface, (1) the vertical adjustment device including a remote-controlled motor drive for operating the vertical adjustment device.

12. A rail grinding unit for grinding surface irregularities on a rail head of at least one rail of a railroad track having two rails, which comprises (a) a support frame having opposite ends, (b) an undercarriage having flanged wheels supporting each support frame end on the rails for mobility along the railroad track, (c) a carrier frame mounted on the support frame, (d) an endless grinding band mounted on the carrier frame and being vertically adjustable with respect to the support frame, (1) the grinding band being trained about two upper guide rollers under tension for rotation thereabout, the upper guide rollers being mounted on the carrier frame sequentially in a longitudinal direction of the rail in a vertical plane, and a lower one of the guide rollers constituting a pressure roll for pressing the endless grinding band into grinding contact with the surface, the pressure roll being arranged in said plane substantially centrally between the upper guide rollers and having a diameter larger than that of the upper guide rollers, (e) a remote-controlled motor drive arranged to adjust the guide rollers in unison vertically with respect to the machine frame, and (f) a vertical adjustment device connected to the support frame for adjusting the depth of the grinding contact of the endless grinding band with the pressure roll in relation to the surface, (1) the vertical adjustment device including a remote-controlled motor drive for operating that vertical adjustment device.

13. The grinding unit of claim 12, wherein the diameter of the pressure rolls is twice as large as that of the tension rolls.

* * * * *

UNITED STATES PATENT AND TRADEMARK OFFICE

CERTIFICATE OF CORRECTION

PATENT NO. : 4,896,460

DATED : January 30, 1990

INVENTOR(S) : J. Theurer et al

It is certified that error appears in the above-identified patent and that said Letters Patent is hereby corrected as shown below:

Insert Figures 7-9 as part of Letters Patent as shown on the attached sheet.

Signed and Sealed this

Fourth Day of December, 1990

*Attest:*

HARRY F. MANBECK, JR.

*Attesting Officer*

*Commissioner of Patents and Trademarks*